US007307606B1

(12) United States Patent
Yamazaki et al.

(10) Patent No.: US 7,307,606 B1
(45) Date of Patent: Dec. 11, 2007

(54) IMAGE FORMING APPARATUS

(75) Inventors: Tatsuro Yamazaki, Machida (JP); Naoto Abe, Yokohama (JP); Makiko Mori, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/542,460

(22) Filed: Apr. 4, 2000

(30) Foreign Application Priority Data

Apr. 5, 1999 (JP) ..... 11-098131
Sep. 21, 1999 (JP) ..... 11-267468

(51) Int. Cl.
*G09G 3/30* (2006.01)

(52) U.S. Cl. ..... 345/77; 345/82; 345/690; 345/204; 315/169.3

(58) Field of Classification Search ..... 345/76–86, 345/690–693, 104, 204; 315/169.1–169.4, 315/169.3; 348/254, 441–459, 797–799, 348/800–803; 313/484, 586
See application file for complete search history.

(56) References Cited

U.S. PATENT DOCUMENTS 4,021,607 A * 5/1977 Amano ..... 348/800
4,839,563 A * 6/1989 Boudreau et al. ..... 315/169.3
4,904,895 A 2/1990 Tsukamoto et al. ..... 313/336
5,027,036 A * 6/1991 Ikarashi et al. ..... 315/169.3
5,066,883 A 11/1991 Yoshioka et al. ..... 313/309
5,155,416 A * 10/1992 Suzuki et al. ..... 315/366
5,185,602 A * 2/1993 Bassetti et al. ..... 345/89
5,216,331 A * 6/1993 Hosokawa et al. ..... 315/169.3
5,300,960 A * 4/1994 Pham et al. ..... 347/130
5,307,085 A 4/1994 Nakamura ..... 345/99
5,569,974 A 10/1996 Morikawa et al. ..... 313/310
5,682,085 A 10/1997 Suzuki et al. ..... 315/169.1
5,754,148 A * 5/1998 Kishino et al. ..... 345/75.2

(Continued)

FOREIGN PATENT DOCUMENTS

JP 64-31332 2/1989

(Continued)

OTHER PUBLICATIONS

M.I. Elinson, et al., "The Emission of Hot Electrons and the Field Emission of Electrons From Tin Oxide", Radio Engineering and Electronic Physics, pp. 1290-1296 (Jul. 1965).

(Continued)

*Primary Examiner*—Lun-Yi Lao
(74) *Attorney, Agent, or Firm*—Fitzpatrick, Cella, Harper & Scinto

(57) ABSTRACT

An image forming apparatus having a display panel with 1,920×480 electron-emitting devices arranged in a matrix and a plurality of fluorescent substances for emitting light by electrons emitted by these electron-emitting devices includes, as one of circuits for driving the display panel, an I/P converter for converting an interlaced scanning signal input at an NTSC image frame rate by a double frame rate and converting the signal into a non-interlaced scanning signal. The signal is controlled to define the maximum time interval during which the fluorescent substances are continuously irradiated with electrons from the electron-emitting devices in units of rows in line-sequential scanning, so as not to substantially degrade the linearity of the luminance characteristic of the fluorescent substances that changes depending on an electron irradiation time for the fluorescent substances.

9 Claims, 15 Drawing Sheets

U.S. PATENT DOCUMENTS

| | | | | |
|---|---|---|---|---|
| 5,872,541 | A * | 2/1999 | Yoshioka et al. | 345/74.1 |
| 6,002,206 | A * | 12/1999 | Harrison et al. | 313/506 |
| 6,008,588 | A * | 12/1999 | Fujii | 315/169.3 |
| 6,025,819 | A * | 2/2000 | Xie et al. | 345/75.1 |
| 6,288,745 | B1 * | 9/2001 | Okuno et al. | 348/448 |
| 6,472,946 | B2 * | 10/2002 | Takagi | 332/109 |

FOREIGN PATENT DOCUMENTS

| | | | |
|---|---|---|---|
| JP | 2-257551 | | 10/1990 |
| JP | 3-55738 | | 3/1991 |
| JP | 4-28137 | | 1/1992 |
| JP | 05-35207 | * | 2/1993 |
| JP | 05150743 | * | 6/1993 |
| JP | 10-308189 | | 11/1998 |
| JP | 11-85097 | | 3/1999 |
| JP | 11-249614 | | 9/1999 |
| JP | 2000-122599 | | 4/2000 |

OTHER PUBLICATIONS

G. Dittmer, Electrical Conduction and Electron Emission of Discontinuous Thin Films, Thin Solid Films, 9, pp. 317-328 (1972).

H. Araki, et al., "Electroforming and Electron Emission of Carbon Thin Films", pp. 22-29 (Jan. 26, 1983).

M. Hartwell, et al., "Strong Electron Emission From Patterned Tin-Indium Oxide Thin Films", International Electron Devices Meeting, pp. 519-521 (1975).

W.P. Dyke, et al., "Field Emission", Advances in Electronics and Electron Physics, vol. VIII, pp. 89-185 (1956).

C.A. Spindt, et al., "Physical Properties of Thin-Film Field Emission Cathodes with Molybdenum Cones", Journal of Applied Physics, vol. 47, No. 12, pp. 5248-5263 (Dec. 1976).

C.A. Mead, "Operation of Tunnel-Emission Devices", Journal of Applied Physics, vol. 32, No. 4, pp. 646-652 (Apr. 1961).

R. Meyer, "Recent Devepolment on "Microtips" Display at LETI", Technical Digest of IVMC 91, pp. 6-9 (1991).

* cited by examiner

IMAGE FORMING APPARATUS

FIELD OF THE INVENTION

The present invention relates to an image forming apparatus using, e.g., cold cathode electron-emitting devices as an electron source, which are arranged in a matrix, and an image forming method in this apparatus.

BACKGROUND OF THE INVENTION

Conventionally, two types of devices, namely thermionic and cold cathode devices, are known as electron-emitting devices. Known examples of the cold cathode devices are surface-conduction type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction type electron-emitting devices is described in, e.g., M. I. Elinson, "Radio Eng. Electron Phys., 10, 1290 (1965) and other examples will be described later.

The surface-conduction type electron-emitting device utilizes the phenomenon that electrons are emitted by a small-area thin film formed on a substrate by flowing a current parallel through the film surface. The surface-conduction type electron-emitting device includes electron-emitting devices using an Au thin film [G. Dittmer, "Thin Solid Films", 9, 317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 10 is a plan view showing the device by M. Hartwell et al. described above as a typical example of the device structures of these surface-conduction type electron-emitting devices.

Referring to FIG. 10, reference numeral 3001 denotes a substrate; and 3004, a conductive thin film made of a metal oxide formed by sputtering. This conductive thin film 3004 has an H-shaped pattern, as shown in FIG. 10. Electrification processing (to be referred to as forming processing to be described later) is performed for the conductive thin film 3004 to form an electron-emitting portion 3005. An interval L in FIG. 10 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction type electron-emitting devices by M. Hartwell et al. and the like, typically the electron-emitting portion 3005 is formed by performing electrification processing called forming processing for the conductive thin film 3004 before electron emission. In forming processing, a constant DC voltage or a DC voltage which increases at a very low rate of, e.g., 1 V/min is applied across the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. When an appropriate voltage is applied to the conductive thin film 3004 after forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenum cones", J. Appl. Phys., 46, 5248 (1976).

FIG. 11 is a sectional view showing the device by C. A. Spindt et al. described above as a typical example of the FE type device structure. In FIG. 11, reference numeral 3010 denotes a substrate; 3011, an emitter wiring made of a conductive material; 3012, an emitter cone; 3013, an insulating layer; and 3014, a gate electrode. This device emits electrons from the distal end of the emitter cone 3012 by applying an appropriate voltage between the emitter cone 3012 and the gate electrode 3014.

In another FE type device structure, an emitter and gate electrode are arranged on a substrate to be almost parallel to the substrate surface, unlike the multi-layered structure shown in FIG. 11.

A known example of the MIM type electron-emitting devices is described in C. A. Mead, "Operation of Tunnel-Emission Devices", J. Appl. Phys., 32, 646 (1961). FIG. 12 shows a typical example of the MIM type device structure.

In FIG. 12, reference numeral 3020 denotes a substrate; 3021, a lower electrode made of a metal; 3022, a thin insulating layer having a thickness of about 100 Å; and 3023, an upper electrode made of a metal having a thickness of about 80 to 300 Å. The MIM type electron-emitting device emits electrons from the surface of the upper electrode 3023 by applying an appropriate voltage between the upper and lower electrodes 3023 and 3021.

Since the above-described cold cathode devices can emit electrons at a temperature lower than that for thermionic cathodes, they do not require any heater. The cold cathode device has a structure simpler than that of the thermionic cathode and can shrink in feature size. Even if a large number of devices are arranged on a substrate at a high density, problems such as heat fusion of the substrate hardly arise. In addition, the response speed of the cold cathode device is high, while the response speed of the thermionic cathode device is low because the thermionic cathode device operates upon heating by a heater.

For this reason, applications of cold cathode devices have enthusiastically been studied. Of cold cathode devices, the surface-conduction type electron-emitting device has a simple structure and can be easily manufactured, which allows forming many devices on a wide area. As disclosed in Japanese Patent Laid-Open No. 64-31332 filed by the present applicant, a method of arranging and driving a lot of devices has been studied.

Regarding applications of surface-conduction type electron-emitting devices to, e.g., image forming apparatuses such as an image display apparatus and image recording apparatus, charge beam sources and the like have been studied.

Particularly as an application to image display apparatuses, an image display apparatus using a combination of a surface-conduction type electron-emitting device and a fluorescent substance which emits light upon irradiation of an electron beam has been studied, as disclosed in the U.S. Pat. No. 5,066,883 and Japanese Patent Laid-Open Nos. 2-257551 and 4-28137 filed by the present applicant. This type of image display apparatus using a combination of a surface-conduction type electron-emitting device and fluorescent substance is expected to exhibit more excellent characteristics than other conventional image display apparatuses. For example, compared with recent popular liquid crystal display apparatuses, the above display apparatus is superior in that it does not require any backlight because of a self-emission type and has a wide view angle.

A method of driving many FE type electron-emitting devices arranged side by side is disclosed in, e.g., U.S. Pat. No. 4,904,895 filed by the present applicant. A known application of FE type electron-emitting devices to an image display apparatus is a flat panel display reported by R. Meyer et al. [R. Meyer: "Recent Development on Micro-tips Display at LETI", Tech. Digest of 4th Int. Vacuum Microelectronics Conf., Nagahama, pp. 6-9 (1991)].

An application of MIM type electron-emitting devices arranged side by side to an image display apparatus is disclosed in Japanese Patent Laid-Open No. 3-55738 filed by the present applicant.

Of these image forming apparatuses using electron-emitting devices, a flat display apparatus, which is space-saving and lightweight, receives a great deal of attention as a substitute for an image display apparatus of a cathode ray tube type.

FIG. 13 is a perspective view showing an example of a display panel constituting a flat image display apparatus, in which part of the panel is removed to show the internal panel structure. In FIG. 13, reference numeral 3115 denotes a rear plate; 3116, a side wall; and 3117, a face plate. The rear plate 3115, side wall 3116, and face plate 3117 constitute an envelope (airtight container) for keeping the interior of the display panel vacuum.

The rear plate 3115 is fixed to a substrate 3111, and n×m cold cathode devices 3112 are formed on the substrate 3111 (n and m are positive integers equal to 2 or more, and properly set in accordance with a target number of display pixels). The n×m cold cathode devices 3112 are wired by m row-direction wirings 3113 and n column-direction wirings 3114, as shown in FIG. 13. A structure constituted by the substrate 3111, cold cathode devices 3112, and row- and column-direction wirings 3113 and 3114 will be referred to as a multi electron source. An insulating layer (not shown) is formed between the row- and column wirings 3113 and 3114 at their intersection so as to maintain electrical insulation.

A fluorescent film 3118 is formed from a fluorescent substance under the face plate 3117, and colored with fluorescent substances (not shown) of three, red (R), green (G), and blue (B) primary colors. A black conductive material (not shown) is applied between fluorescent substances of respective colors forming the fluorescent film 3118. A metal back 3119 is made of Al or the like on a surface of the fluorescent film 3118 on the rear plate 3115 side.

In FIG. 13, reference symbols Dxl to Dxm, Dyl to Dyn, and Hv denote electrical connection terminals for an airtight structure that are provided to electrically connect the display panel to an electrical circuit (not shown). The terminals Dxl to Dxm are electrically connected to the row-direction wirings 3113 of the multi electron source; Dyl to Dyn, to the column-direction wirings 3114 of the multi electron source; and Hv, to the metal back 3119.

The interior of the airtight container is kept at a vacuum of about $10^{-6}$ Torr. As the display area of the image display apparatus increases, the display panel requires a means for preventing deformation or destruction of the rear and face plates 3115 and 3117 caused by the difference between inner and outer pressures of the airtight container. For this purpose, the display panel in FIG. 13 adopts a structure support (to be referred to as a spacer or rib) 3120 which is made of a relatively thin glass plate and supports the airtight container against the atmospheric pressure. This spacer generally maintains an interval of sub-mm to several mm between the substrate 3111 having the multi beam electron source and the face plate 3117 having the fluorescent film 3118. Accordingly, high vacuum is kept inside the airtight container, as described above.

The image display apparatus using this display panel emits electrons from the cold cathode devices 3112 by selectively applying a voltage to the cold cathode devices 3112 via the external terminals Dxl to Dxm and Dyl to Dyn. At the same time, a high voltage of several hundred V to several kV is applied to the metal back 3119 via the external terminal Hv to accelerate the emitted electrons and collide them against an inner side of the face plate 3117. This excites fluorescent substances of respective colors forming the fluorescent film 3118, thereby emitting light. An image is displayed by a method called interlaced scanning of dot-sequentially switching driving of devices one by one, or non-interlaced scanning (or progressive scanning) of line-sequentially switching driving of devices in units of lines. To express the tone, the display luminance can be changed by controlling a continuous electrons irradiation time for fluorescent substances in correspondence with a desired luminance level.

When the above-described image forming apparatus adopts line-sequential scanning capable of simultaneously emitting light from fluorescent substances on one line, the driving time of each device is longer than that in dot-sequential scanning of sequentially scanning fluorescent substances on one line to emit light, and the electron irradiation time for fluorescent substances is also longer. A long electron irradiation time for fluorescent substances widens the tonal expression. However, the present inventors have further enthusiastically studied to find that the luminance characteristic of the fluorescent substance loses its linearity as the electron irradiation time for fluorescent substances becomes longer, and the electron irradiation time for fluorescent substances must be set to fall within a predetermined time period in order to implement high-quality tonal expression. To satisfy this setting condition, the clamp period (time during which fluorescent substances are not irradiated with any electrons) may be prolonged in the selection period of each of scanning lines (e.g., 480 lines) constituting one frame. However, this method results in a dark display image.

SUMMARY OF THE INVENTION

The present invention has been made in consideration of the above situation, and has as its object to provide an image forming apparatus capable of implementing higher-quality tonal expression.

According to one aspect of the present invention, an image forming apparatus including a plurality of electron-emitting devices arranged in a matrix of rows and columns, and fluorescent substances for emitting light by electrons emitted by the electron-emitting devices is characterized by comprising frame rate conversion means for converting a frame rate of an input image signal, wherein a signal output from the frame rate conversion means is a signal having a maximum time interval during which the fluorescent substances are continuously irradiated with electrons from the electron-emitting devices in units of rows in line-sequential scanning, so as not to substantially degrade linearity of a luminance characteristic of the fluorescent substances that changes depending on an electron irradiation time for the fluorescent substances.

According to another aspect of the present invention, an image forming apparatus including a plurality of electron-emitting devices arranged in a matrix of rows and columns, and fluorescent substances for emitting light by electrons emitted by the electron-emitting devices is characterized by comprising a frame rate conversion circuit for converting a frame rate of an input image signal, wherein a signal output from the frame rate conversion circuit is a signal having a maximum time interval during which the fluorescent substances are continuously irradiated with electrons from the electron-emitting devices in units of rows in line-sequential scanning, so as not to substantially degrade linearity of a luminance characteristic of the fluorescent substances that changes depending on an electron irradiation time for the fluorescent substances.

In each aspect, the frame rate is preferably converted simultaneously when a signal for an interlaced scanning is converted into a signal for a non-interlaced scanning signal.

Each aspect is particularly preferable for an arrangement in which pulse width modulation is performed by the signal whose frame rate is converted.

In each aspect, the frame rate is preferably converted to shorten the maximum time interval during which the fluorescent substances are continuously irradiated with electrons from the electron-emitting devices in units of rows in line-sequential scanning, compared to a case in which the frame rate is not converted.

According to still another aspect of the present invention, an image forming apparatus including a plurality of electron-emitting devices arranged in a matrix of rows and columns, and fluorescent substances for emitting light by electrons emitted by the electron-emitting devices is characterized by comprising signal processing means, wherein the signal processing means converts an input signal into a signal having a maximum time interval during which the fluorescent substances are continuously irradiated with electrons from the electron-emitting devices in rows of lines in line-sequential scanning, so as not to substantially degrade linearity of a luminance characteristic of the fluorescent substances that changes depending on an electron irradiation time for the fluorescent substances.

According to still another aspect of the present invention, an image forming apparatus including a plurality of electron-emitting devices arranged in a matrix of rows and columns, and fluorescent substances for emitting light by electrons emitted by the electron-emitting devices is characterized by comprising a signal processing circuit, wherein the signal processing circuit converts an input signal into a signal having a maximum time interval during which the fluorescent substances are continuously irradiated with electrons from the electron-emitting devices in units of rows in line-sequential scanning, so as not to substantially degrade linearity of a luminance characteristic of the fluorescent substances that changes depending on an electron irradiation time for the fluorescent substances.

In each aspect, the signal processing is preferably performed simultaneously when a signal for an interlaced scanning is converted into a signal for a non-interlaced scanning signal.

Each aspect is particularly preferable for an arrangement in which pulse width modulation is performed by the processed signal.

Each aspect can preferably adopt surface-conduction type electron-emitting devices as the electron-emitting devices.

Each aspect is preferable for an arrangement in which the image forming apparatus further comprises an electrode to which a potential for accelerating electrons emitted by the electron-emitting devices applies, and the potential is higher by not less than 500 V than a potential applied to the electron-emitting devices in order to emit electrons. Each aspect is more preferably employed when the electrode receives a potential higher by not less than 3 kV than a potential applied to the electron-emitting devices in order to emit electrons. Each aspect is still more preferably employed when the electrode receives a potential higher by not less than 5 kV than a potential applied to the electron-emitting devices in order to emit electrons.

According to the above aspects, the maximum time interval during which the fluorescent substances are continuously irradiated with electrons from the electron-emitting devices in units of rows (lines) in line-sequential scanning is set within a time during which the linearity of the fluorescent substance luminance characteristic which changes depending on the electron irradiation time for the fluorescent substances does not substantially degrade. This can implement high-quality wide tonal expression in line-sequential scanning. By determining the setting time by frame rate conversion, a decrease in the brightness of a display image can be suppressed. At the same time as interlaced/non-interlaced (progressive) conversion, the frame rate can be converted. The present invention is very effective for an arrangement in which the maximum time interval substantially degrades the linearity if an image signal is input as a driving signal without any signal processing.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

A preferred embodiment of the present invention will be described below with reference to the accompanying drawings.

Figure 1A:
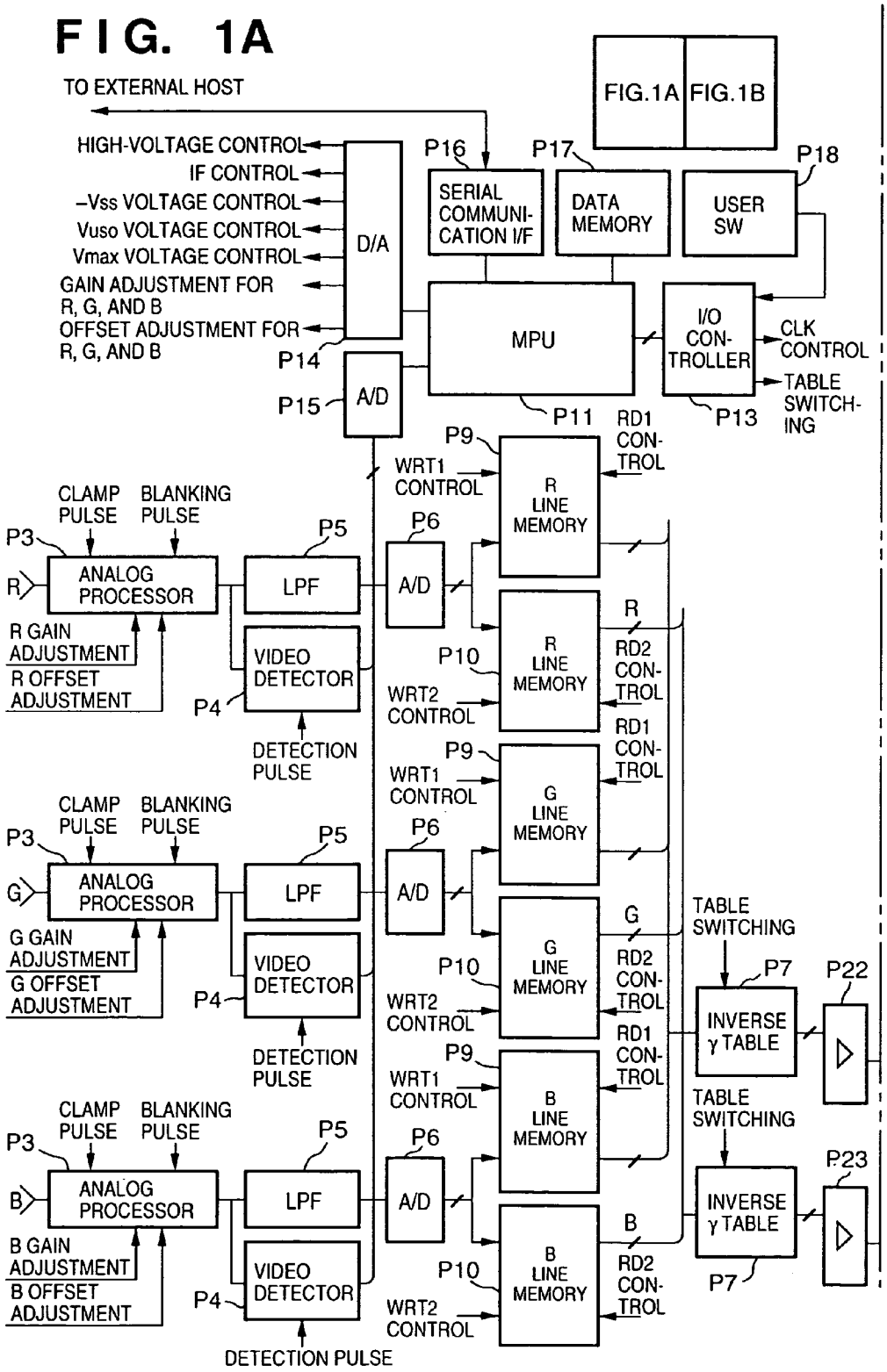
FIGS. 1A to 1C are block diagrams showing the driving circuit of an SED panel as an embodiment of an image forming apparatus according to the present invention.
Figure 1B:
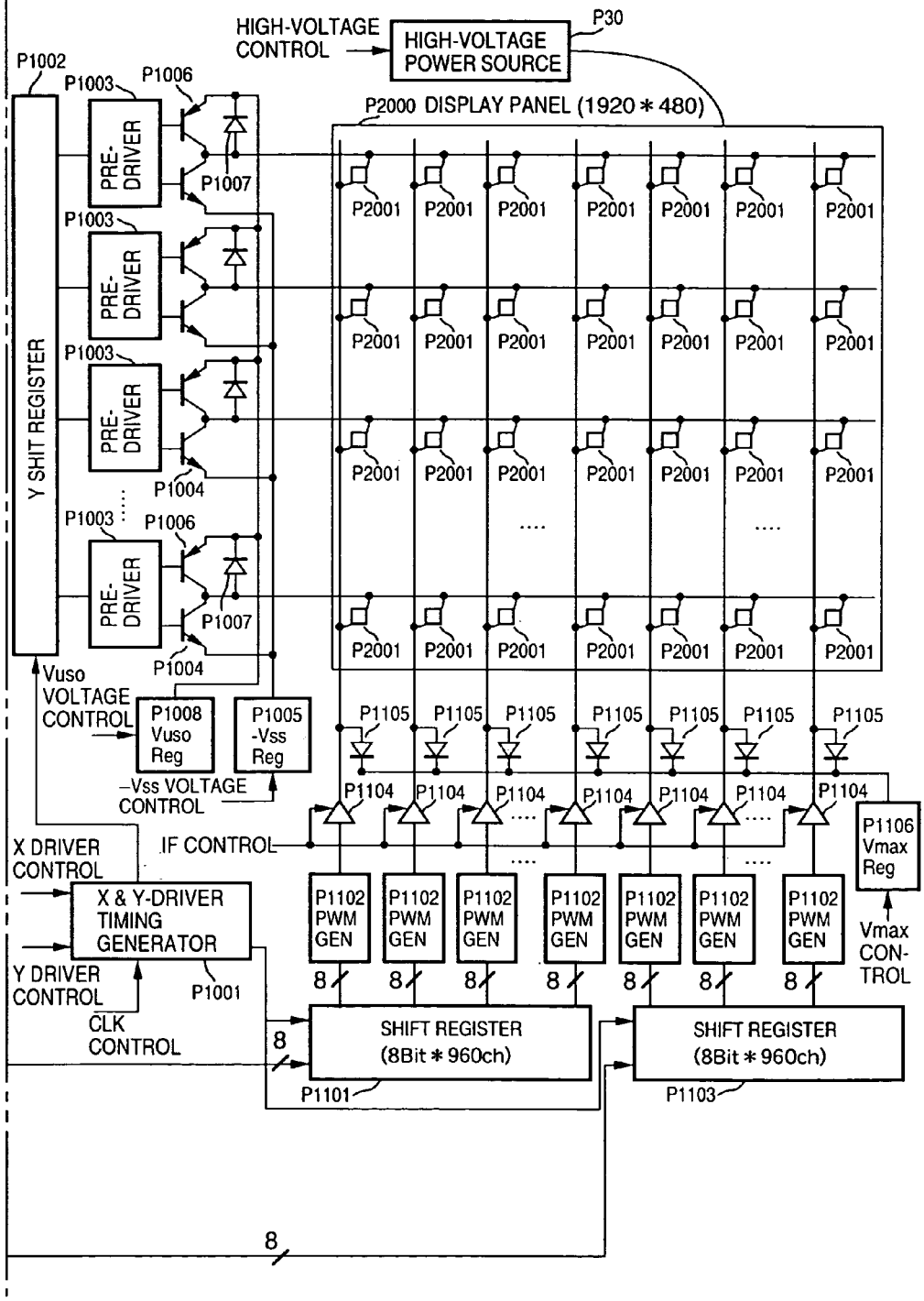
Figure 1C:
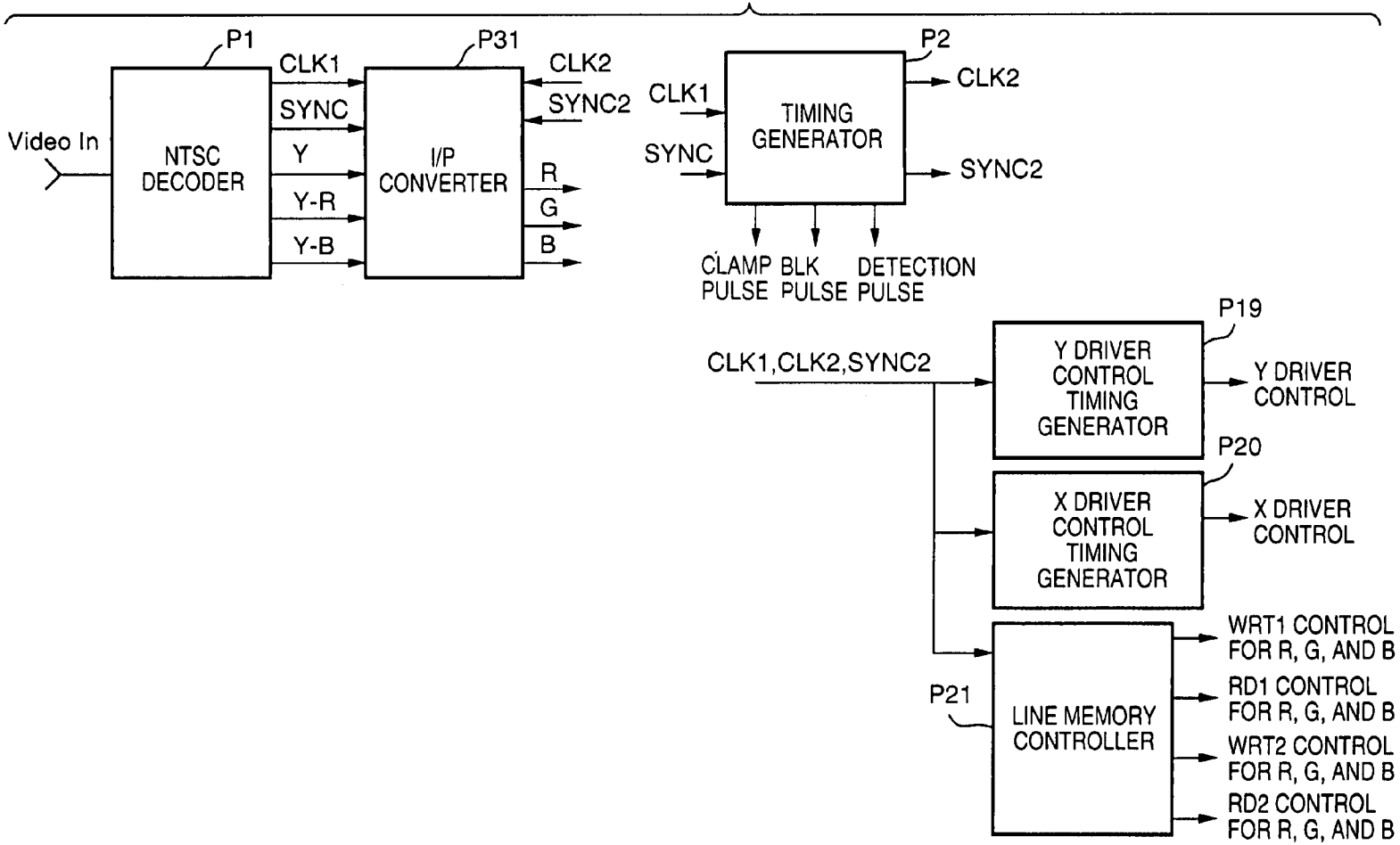
Figure 3:
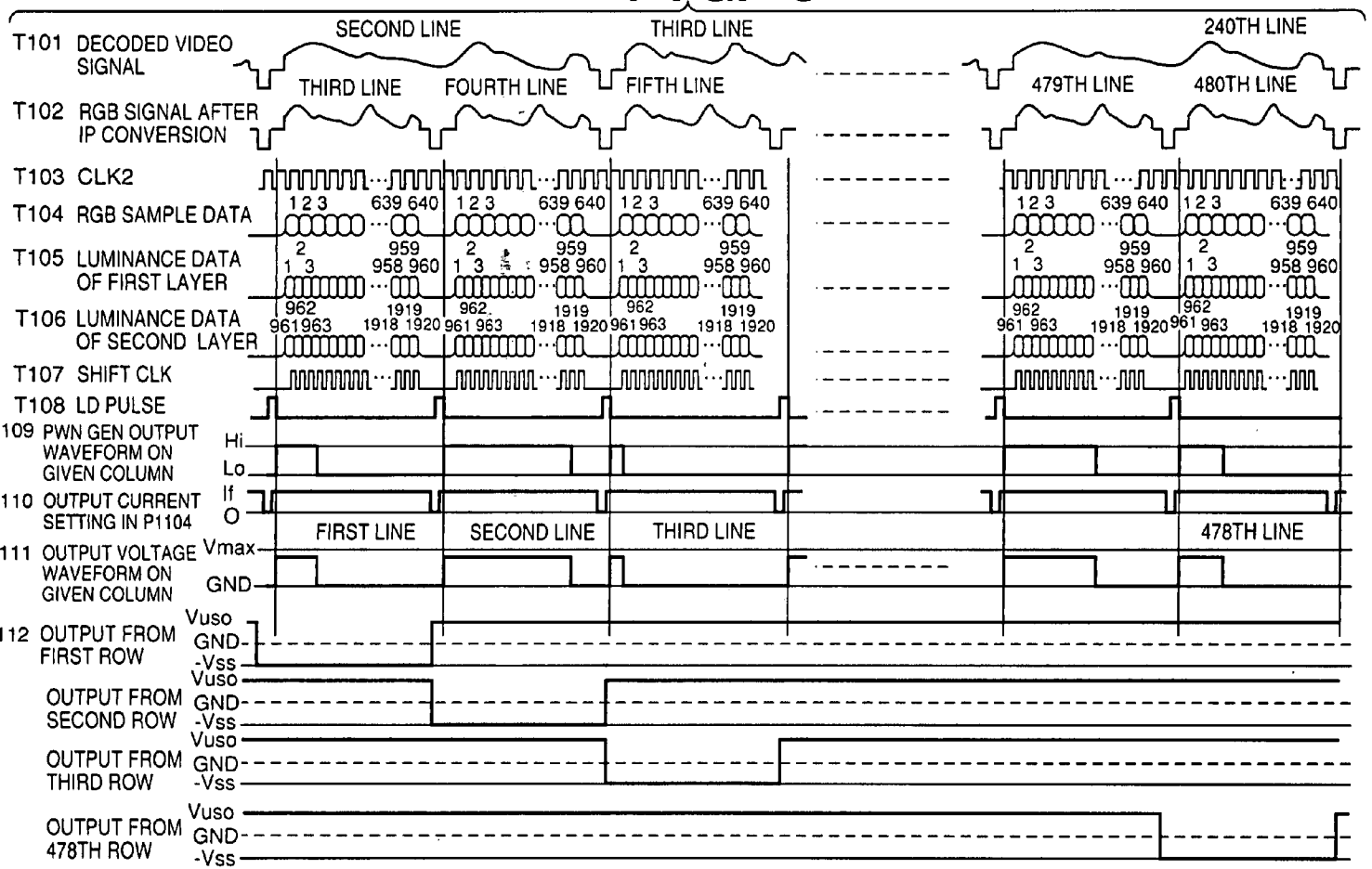
FIG. 3 is a timing chart of the driving circuit shown in FIGS. 1A to 1C.

FIGS. 1A to 1C are block diagrams showing the driving circuit of an SED (Surface Conduction type of Electron-Emitting Display) panel as an embodiment of an image forming apparatus according to the present invention. FIG. 3 it a timing chart of the driving circuit shown in FIGS. 1A to 1C.

Figure 13:
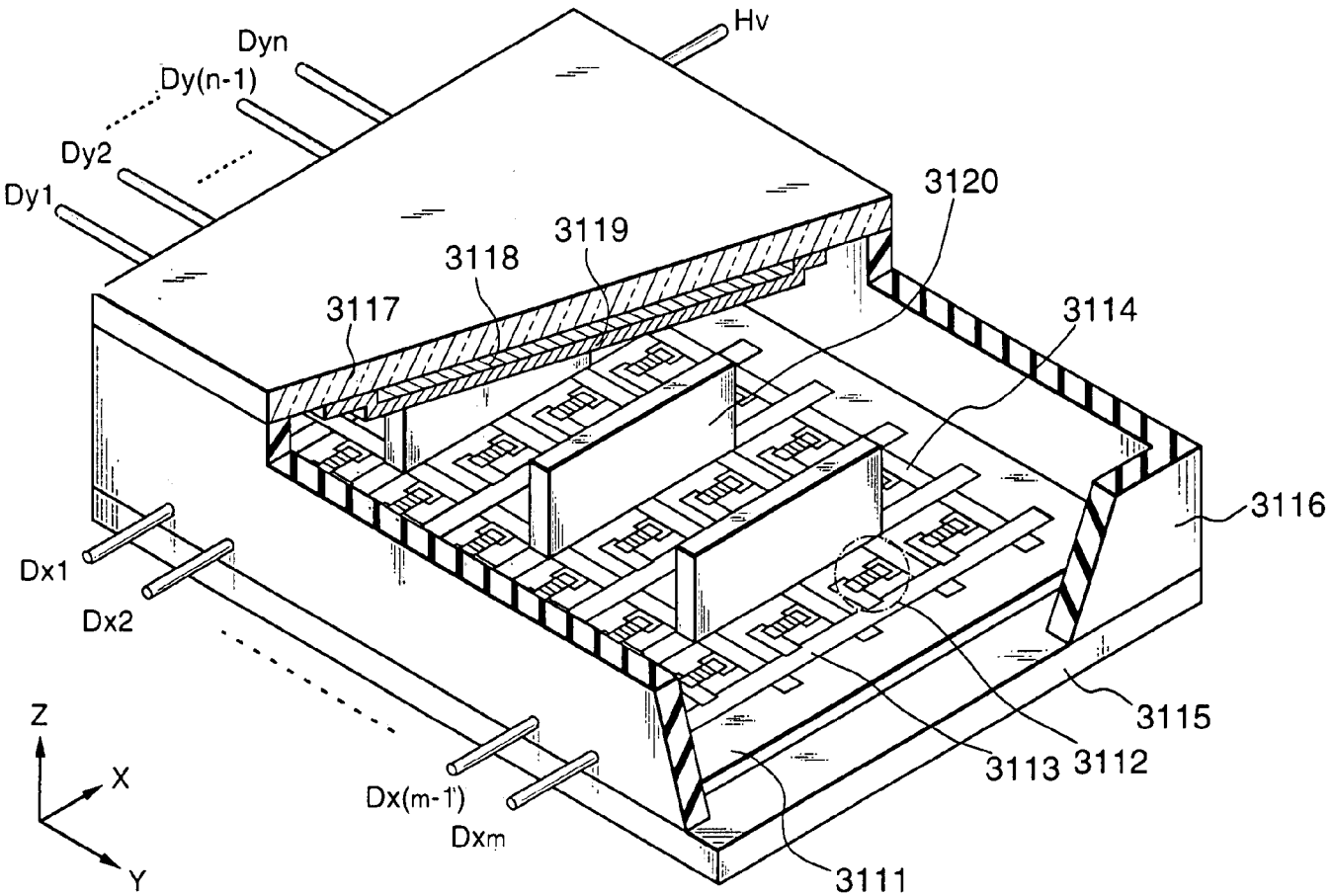
FIG. 13 is a partially cutaway perspective view showing the display panel of a conventional image display apparatus.

In FIG. 1B, reference symbol P2000 denotes a display panel whose structure is the same as that of a conventional panel shown in FIG. 13. In this embodiment, 480×1,920 surface-conduction emission type devices P2001 are arranged in a matrix using 480 row wirings extending in the horizontal direction of the display (vertical direction in FIG. 1B), and 1,920 column wirings extending in the vertical direction of the display (horizontal direction in FIG. 1B). An electron beam emitted by each surface-conduction emission type device P2001 is accelerated by a high voltage applied from a high-voltage power source P30 to irradiate a fluorescent substance (not shown), thereby emitting light. The fluorescent substance (not shown) can take various color layouts in accordance with application purposes. For example, the fluorescent substance takes a vertical striped color layout of R, G, and B colors.

This embodiment will exemplify an application of displaying an NTSC television image on a display panel having pixels of 640 horizontal lines (R, G, and B trio)×480 vertical lines. Almost the same arrangement can cope with not only the NTSC image but also image signals having different resolutions and image frame rates, such as a high-resolution HDTV image and computer output image.

Reference symbol P1 (FIG. 1C) denotes an NTSC decoder. The NTSC decoder P1 receives an NTSC composite video input and outputs a luminance signal (Y) and color difference signals (Y−R and Y−B). This decoder P1 separates and outputs a sync signal (SYNC) superposed on an input video signal. Similarly, the decoder P1 separates a color burst signal superposed on the input video signal, and generates and outputs a CLK signal (CLK1) which synchronizes with the color burst signal.

Reference symbol P31 denotes an I/P converter (Interlaced-to-Progressive converter). In this embodiment, the I/P converter P31 receives the interlaced luminance signal (Y) and color difference signals (Y−R and Y−B) decoded by the NTSC decoder P1, and generates double scanning line signals per field, thereby converting the interlaced signals into progressive (non-interlaced scanning) signals. In this embodiment, the I/P converter P31 comprises a matrix circuit for converting color difference signals into R, G, and B primary color signals.

Figure 2:
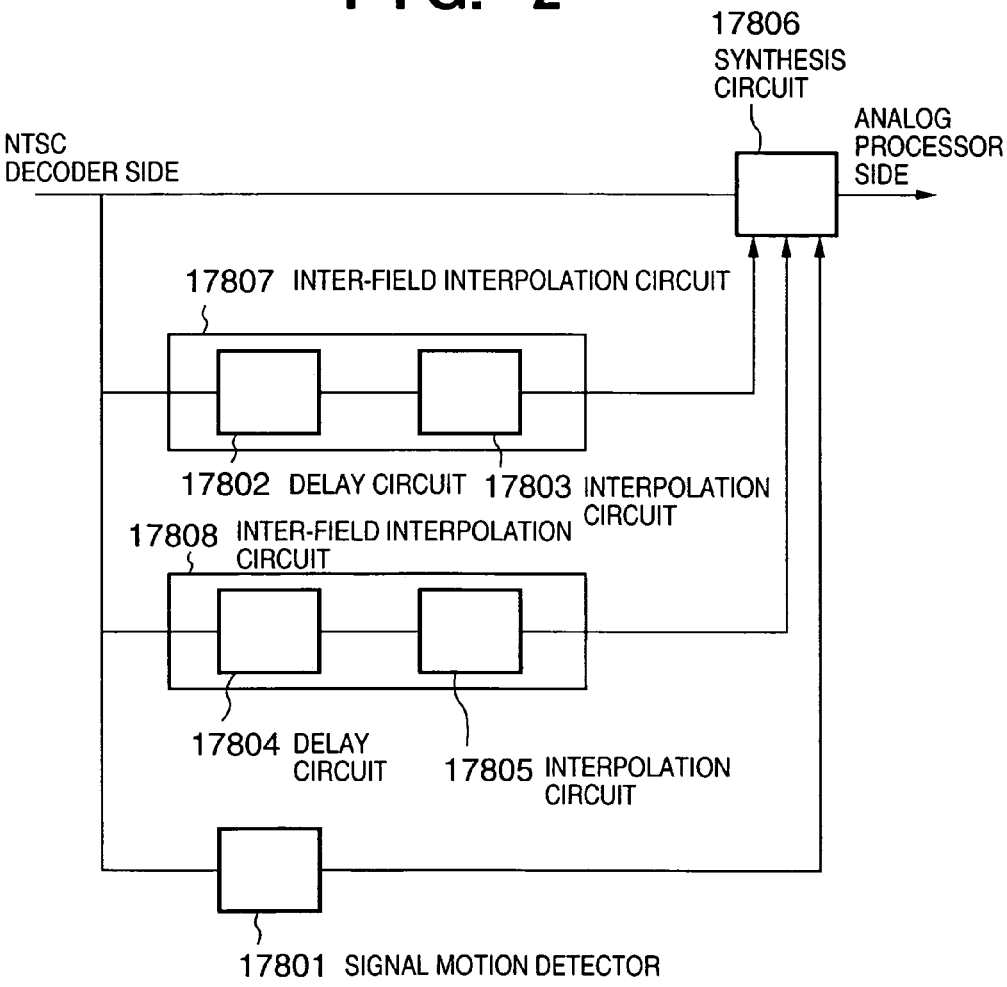
FIG. 2 is a block diagram showing an arrangement for IP conversion in the embodiment.

A detailed arrangement for IP conversion is shown in FIG. 2. This embodiment uses both inter-field interpolation and intra-field interpolation to generate a scanning line interpolation signal in converting an interlaced signal into a progressive signal. FIG. 2 shows an IP conversion arrangement for one input.

In FIG. 2, reference numeral 17801 denotes a signal motion detector. When an image signal greatly moves, intra-field interpolation is preferably done; and when an image signal hardly moves, inter-field interpolation is preferably done. The motion detector detects the motion of an image signal to determine the synthesis ratio of an inter-field interpolation signal and intra-field interpolation signal. Reference numeral 17807 denotes an inter-field interpolation circuit. The inter-field interpolation circuit 17807 determines a scanning line signal between every two scanning line signals on the basis of a scanning line signal for a preceding field, e.g., an immediately preceding field. More specifically, a signal for a corresponding scanning line of an immediately preceding field is used as a scanning line signal between every two scanning line signals. Reference numeral 17802 denotes a delay circuit. The delay circuit 17802 delays an image signal and outputs the delayed signal in order to perform inter-field interpolation. Reference numeral 17803 denotes an interpolation circuit. The interpolation circuit 17803 generates an interpolation scanning line signal from the delayed preceding field signal output from the delay circuit 17802. Reference numeral 17808 denotes an intra-field interpolation circuit. The intra-field interpolation circuit 17808 synthesizes a plurality of scanning line signals, e.g., ever two scanning signals, thereby generating a scanning line signal between every two scanning line signals. Reference numeral 17804 denotes a delay circuit. The delay circuit 17804 delays an image signal and outputs the delayed signal in order to perform intra-field interpolation. Reference numeral 17805 denotes an interpolation circuit. The interpolation circuit 17805 synthesizes the preceding scanning line signal output from the delay circuit 17804 and a scanning line signal having a different delay amount, e.g., a scanning line signal input without any delay, thereby generating an interpolation scanning line signal. Reference numeral 17806 denotes a synthesis circuit. The synthesis circuit 17806 determines the synthesis ratio of interpolation signals from the interpolation circuits 17803 and 17805 in accordance with a signal from the motion detector 17801, and outputs a progressive signal. In this conversion, the signal may be a digital signal, and the delay circuit may be a memory. The IP conversion arrangement is not limited to a hardware arrangement, and may be implemented by software using an arithmetic circuit. Only either inter-field interpolation or intra-field interpolation may be executed.

Reference symbol P2 (FIG. 1C) denotes a timing generator. The timing generator P2 generates the following timing signals necessary for converting progressive-converted analog R, G, and B signals output from the I/P converter P31 into digital tone signals for modulating the luminance of the SED panel.

- Clamp pulse for DC-regenerating R, G, and B analog signals from the I/P converter P31 by analog processors P3
- Blanking pulse (BLK pulse) for adding blanking periods to the R, G, and B analog signals from the I/P converter P31 by the analog processors P3
- Detection pulse for detecting the levels of the R, G, and B analog signals by video detectors P4
- Sample pulse (not shown) for converting the R, G, and B analog signals into digital signals by A/D converters P6
- Free-running CLK signal (CLK2) which is generated in the timing generator P2 and, when CLK1 is input, synchronizes with CLK1 by the internal PLL circuit in the timing generator P2.
- Sync signal (SYNC2) generated in the timing generator P2 based on CLK2

The analog processors P3 (FIG. 1A) are disposed for respective primary color signals output from the I/P converter P31. Each analog processor P3 operates mainly as follows.

The analog processor P3 receives a clamp pulse from the timing generator P2 (FIG. 1C) and performs DC regeneration.

The analog processor P3 receives a BLK pulse from the timing generator P2 and adds a blanking period.

The analog processor P3 receives a gain adjustment signal from a D/A converter P14 serving as one of control outputs of a system controller mainly made up of a MPU (MicroProcessing Unit) P11 (FIG. 1A), and controls the amplitudes of primary color signals input from the I/P converter P31 (FIG. 1C).

The analog processor P3 receives an offset adjustment signal from the D/A converter P14 serving as one of control outputs of the system controller mainly made up of the MPU P11, and controls the black levels of primary color signals input from the I/P converter P31.

Each video detector P4 (FIG. 1A) detects an input video signal level or a video signal level after control by the analog processor P3. The video detector P4 receives a detection pulse from the timing generator P2, and the detection result is read by an A/D converter P15 (FIG. 1A) serving as one of control inputs of the system controller mainly made up of the MPU P11.

The detection pulse from the timing generator P2 (FIG. 1C) is formed from, e.g., three type of pulses, such as gate pulse, reset pulse, and sample & hold (to be referred to as S/H hereinafter) pulse. The video detector is comprised of, e.g., an integrator and S/H circuit.

For example, the integrator integrates a video signal in accordance with a gate pulse during the effective period of an input video signal, and the S/H circuit samples an output from the integrator in accordance with an S/H pulse generated during a vertical blanking period. The detection result is read by the A/D converter P15 during this vertical blanking period, and then the integrator and S/H circuit are initialized by a reset pulse. This operation enables detecting the average video level of each field.

Reference symbols P5 (FIG. 1A) denote LPFs. Each LPF P5 is a pre-filter means arranged on the input stage of a corresponding A/D converter P6.

The A/D converter P6 (FIG. 1A) is an A/D converter means for receiving a sample CLK from the timing generator P2 and quantizing an analog primary color signal having passed through the LPF P5 by a necessary number of gray (tone) levels.

In general, an input video signal is displayed on a TV receiver using a CRT, and thus undergoes γ processing in order to correct the nonlinear emission characteristic of the CRT. When a TV image is to be displayed on a display panel having a linear emission characteristic, like this embodiment, the effects of γ processing is preferably cancelled by a gray level characteristic conversion means such as inverse γ tables P7.

The emission characteristic can be properly changed by switching table data by an output from an I/O controller P13 (FIG. 1A) serving as one of control inputs/outputs of the system controller mainly made up of the MPU P11.

Reference symbols P9 and P10 (FIG. 1A) denote horizontal 1-line memory means arranged for respective primary color signals. Luminance data input parallel to three R, G, and B systems are rearranged by a control signal from a line memory controller P21 in accordance with the panel color layout, converted into one serial signal, and output to an X driver via a latch means P22.

This embodiment adopts two horizontal 1-line memory means for each primary color signal. One line memory writes former 320 data per horizontal line out of 640 dot-sequential pixel data, whereas the other line memory writes latter 320 data. Data are read out from the three R, G, and B line memories each storing the former 320 data in an order corresponding to the panel color layout at CLK 1.5 times higher than that in write. The readout data are converted into one serial signal, and output to a shift register P1101 (FIG. 1B) of the X driver via the latch means P22. Similarly, data are read out from the three R, G, and B line memories each storing the latter 320 data in an order corresponding to the panel color layout at CLK 1.5 times higher than that in write. The readout data are converted into one serial signal, and output to a shift register P1103 (FIG. 1B) of the X driver via a latch means P23.

In this example, luminance data is divided into two in order to reduce the data transfer rate of the horizontal shift register of the X driver to ½. For a larger number of pixels of the display panel or a higher frame frequency for driving the display panel, luminance data may be divided into a larger number of data.

The system controller in FIG. 1A is mainly comprised of the MPU P11, a serial communication I/F P16, the I/O controller P13, the D/A converter P14, the A/D converter P15, a data memory P17, and a user SW means P18.

The system controller receives a user request from the user SW means P18 or serial communication I/F P16, and outputs a corresponding control signal from the I/O controller P13 or D/A converter P14, thereby meeting the request.

In addition, the system controller receives a system monitoring signal from the A/D converter P15 and outputs a corresponding control signal from the I/O controller P13 or D/A converter P14, thereby performing optimal automatic control.

In this embodiment, the user request can implement display control such as change of the adjustment amount, brightness, and color control. By monitoring the average video level from the video detector P4 by the A/D converter P15, automatic control such as ABL can be achieved.

The data memory P17 can store the user adjustment amount.

Reference symbol P19 in FIG. 1C denotes a Y-driver control timing generator; and P20, an X-driver control timing generator. Both the generators P19 and P20 receive signals CLK1, CLK2, and SYNC2 to generate Y- and X-driver control signals.

The line memory controller P21 (FIG. 1C) performs timing control of the line memories P9 and P10. The line memory controller P21 receives the signals CLK1, CLK2, and SYNC2, and generates R, G, and B WRT1 control signals and R, G, and B WRT2 control signals for writing luminance data in the line memories, and R, G, and B RD1 control signals and R, G, and B RD2 control signals for reading out luminance data from the line memory in an order corresponding to the panel color layout.

T101 in FIG. 3 represents an example of a luminance signal output from the NTSC decoder P1. This output signal from the NTSC decoder P1 is output with a waveform like T102 as line-sequential R, G, or B signals double in number the scanning lines per frame (field) by the I/P converter P31. The I/P-converted R, G, or B primary color signals are quantized at CLK2 having a frequency like T103 at which a number of data samples corresponding to the number of pixels of the display panel, thereby obtaining a string of 640 sample data per line, like T104, for each of the R, G, and B colors.

Former 320 data of this data string are written in a corresponding line memory P9 in accordance with the R, G, or B WRT1 control signal in one horizontal period, and latter 320 data are written in a corresponding line memory P10 in accordance with the R, G, or B WRT2 control signal.

In the next horizontal period, data are simultaneously read out from the two line memories P9 and P10 for each color in accordance with the color strips of the display panel at a frequency like T107 1.5 times higher that in write. As a result, a string of 960 luminance data like T105 or T106 can be obtained per horizontal period.

Reference symbol P1001 in FIG. 1B denotes an X & Y-driver timing generator. The X & Y-driver timing generator P1001 receives control signals from the Y-driver control timing generator P19 and X-driver control timing generator, and outputs the following signals in order to control the X driver:

Shift clock

LD pulse functioning to fetch data loaded to the shift registers P1101 and P1103 in the internal memory means (not shown) of PWM generators P1102 and the D/A converter P14, and functioning as a horizontal period trigger for the PWM generators P1102 and D/A converters P14

The X & Y-driver timing generator P1001 further outputs a horizontal period shift clock for operating the Y shift register in order to control the Y driver, and a vertical period trigger signal for applying a row scanning start trigger.

The shift registers P1101 and P1103 in FIG. 1B load luminance data strings each for 960 column wirings from the latch means P22 and P23 (FIG. 1A) every horizontal period in accordance with shift CLK like T107 in FIG. 3 from the X & Y-driver timing generator P1001 that is synchronized with luminance data. Then, the shift registers P1101 and P1103 simultaneously transfer 1,920 data for one horizontal line to the PWM generators P1102 in accordance with an LD pulse like T108.

The PWM generator P1102 arranged on each column wiring receives luminance data from the shift register P1101, and generates a pulse signal having a pulse width proportional to the data every horizontal period, such as a waveform T110 in FIG. 3.

A column wiring driver P1104 arranged on each column wiring receives an If control signal from the D/A converter P14 of the system controller, and generates a driving current having a current amplitude proportional to the If control signal like T110.

The column wiring driver P1104 comprises a switching means formed from a transistor or the like. The column wiring driver P1104 applies a driving current to a column wiring while an output from the PWM generator P1102 is valid, and grounds the column wiring while an output from the PWM generator P1102 is invalid. An example of the column wiring driving waveform is represented by T111 in FIG. 3.

A diode means P1105 arranged on each column wiring is connected on its common side to a Vmax regulator P1106. The Vmax regulator P1106 is a constant-voltage source capable of sucking a current, and forms together with the diode means P1105 a protection circuit for preventing an excessive voltage from being applied to 1,920×480 surface-conduction emission type devices of the display panel P2000.

The protection voltage (potential defined by Vmax and −Vss applied upon scanning selection of a row wiring) is applied by the D/A converter P14 serving as one of control inputs/outputs of the system controller mainly made up of the MPU P11.

Hence, the Vmax regulator P1106 can prevent application of an excessive voltage to the device, and can also change the potential Vmax (or potential −Vss) in order to control the luminance.

A Y shift register P1002 (FIG. 1B) receives a horizontal period shift clock and a vertical period trigger signal for supplying a row scanning start trigger from the X & Y-driver timing generator P1001, and sequentially outputs selection signals for scanning row wirings to pre-drivers P1003 arranged on respective row wirings.

An output terminal for driving each row wiring is made up of, e.g., a transistor means P1006, FET means P1004, and diode means P1007, as shown in FIG. 1B. The pre-driver P1003 drives this output terminal at a high response speed. In selecting a row, the FET means P1004 applies the potential −Vss from a constant-voltage regulator P1005 to the row wiring via a switching means which is turned on in selection. The transistor means P1006 is a switching means which is turned on in non-selection, and applies a potential Vuso from the constant-voltage regulator P1005 to the row wiring in non-selection. An example of the row wiring driving waveform is represented by T112 in FIG. 3.

The diode means P1007 is used to prevent generation of an abnormal potential on the row wiring and protect the output terminal for driving each row wiring.

The constant-voltage regulator P1005 and diode means P1007 (FIG. 1B) for generating the potentials −Vss and Vuso are controlled by the D/A converter P14 serving as one of control inputs/outputs of the system controller mainly made up of the MPU P11.

The high-voltage power source P30 (FIG. 1B) is also controlled by the D/A converter P14 serving as one of control inputs/outputs of the system controller mainly made up of the MPU P11. This embodiment applies 7 kV to an acceleration electrode as a potential for accelerating electrons from an electron-emitting device. Since the electron-emitting device is driven around 0 V, it receives substantially 7 kV as an acceleration voltage.

With the above-described arrangement, the display panel having 640 horizontal lines (R, G, and B trio)×480 vertical lines can display an image obtained by converting an NTSC interlaced signal into a progressive signal and doubling the frame rate.

The luminance characteristic of the display panel used in this embodiment will be explained.

Figure 4:
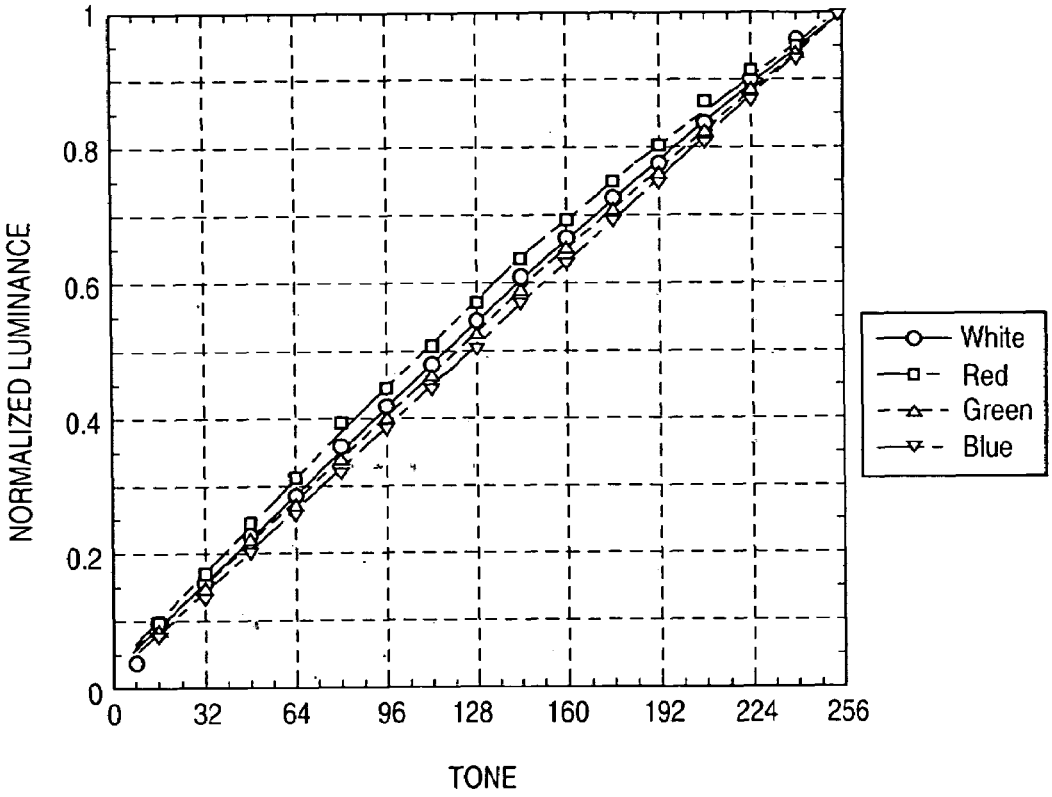
FIG. 4 is a graph showing the tone data-emission luminance characteristic of the display panel when no frame rate is converted in the arrangement shown in FIGS. 1A to 1C.
Figure 5:
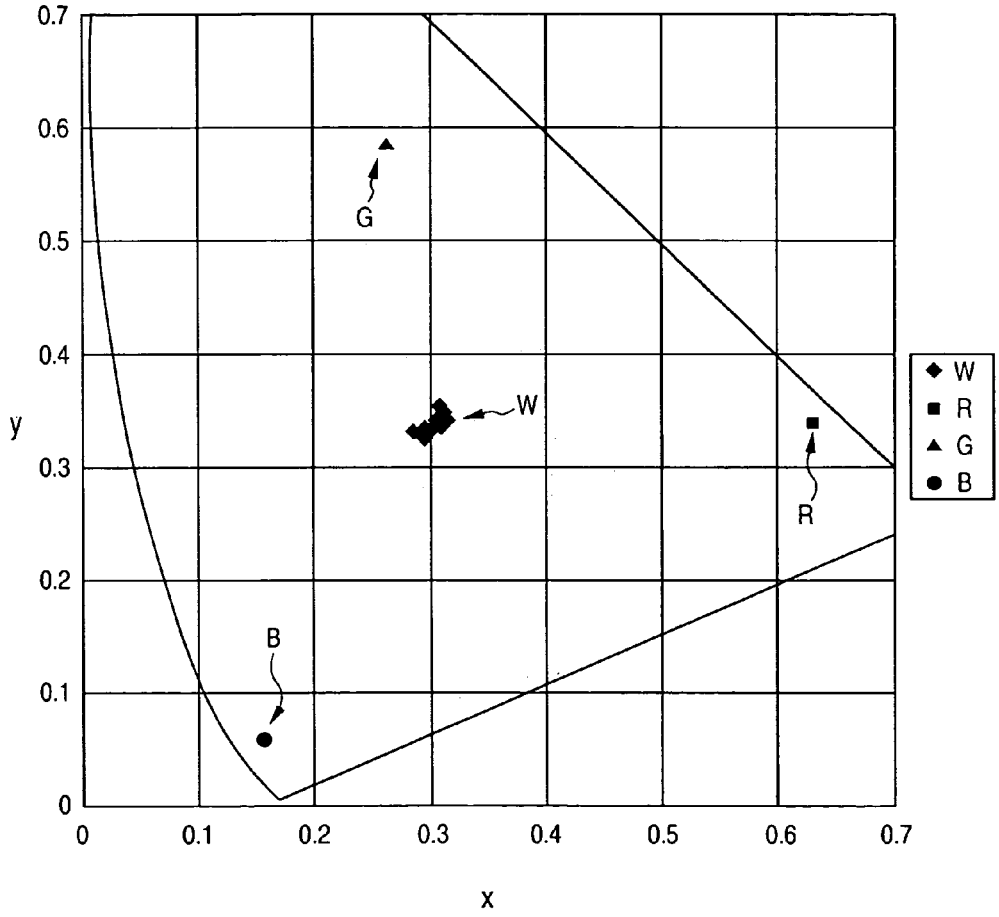
FIG. 5 is a graph showing a change in white chromaticity point by tone data when no frame rate is converted.

FIG. 4 is a graph showing the normalized tone-luminance characteristics of the respective R, G, and B primary colors when interlaced scanning (scanning frequency: about 15.75 kHz) is done at the NTSC rate and the tone is expressed by pulse width modulation of 8 bits (256 gray levels), and the normalized tone-luminance characteristic of white when R, G, and B fluorescent substances simultaneously emit light. The basic unit of pulse width is about 220 ns, and the maximum pulse width is about 56 μs. A change in white chromaticity point by tone data is shown in FIG. 5.

As is apparent from FIG. 4, the emission characteristics of the R, G, and B colors tend to saturate the luminance characteristic as tone data increases (as the application time of a driving pulses prolongs), and the R, G, and B colors exhibit different saturation degrees. Due to different R, G, and B saturation points, the white chromaticity point varies, as shown in FIG. 5.

The arrangement shown in FIGS. 1A to 1C converts the frame rate at the same time as I/P conversion for the same display panel, and then performs pulse width modulation with 8-bit precision. In this case, since frame rate conversion doubles the scanning frequency to 31.5 kHz, the basic unit of the pulse width is about 110 ns, and the maximum pulse width is about 28 μs.

Figure 6:
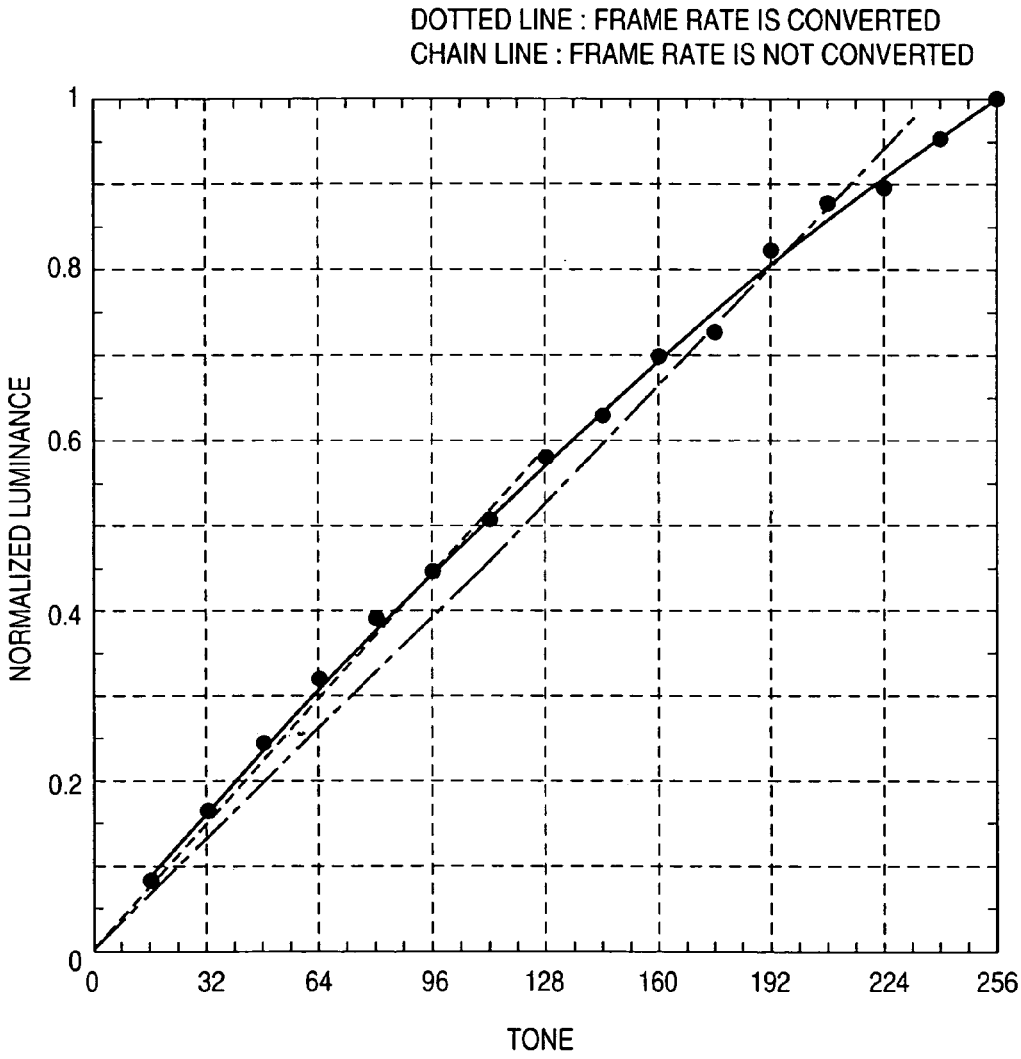
FIG. 6 is a graph showing linear approximation of the panel emission characteristic when the frame rate is not converted and is converted.

FIG. 6 shows a state in which panel emission characteristics when the frame rate is not converted and is converted are fitted by linear approximation. The abscissa represents tone data when no frame rate is converted. When the frame rate is converted, the basic unit time is halved, and a value of 128 along the abscissa corresponds to the maximum pulse width.

From FIG. 6, as the driving time is longer, the saturation trend is stronger. Thus, frame rate conversion makes the emission characteristic come near to a straight line.

In general, an allowable color difference (ΔELab) in a Lab color space corresponding to a color difference in the JIS standard color atlas or Munsell color atlas is said to be about ΔELab=10. This amount corresponds to Δxy=about 0.03 as an allowable color difference (Δxy) in the xyY color space.

Figure 7:
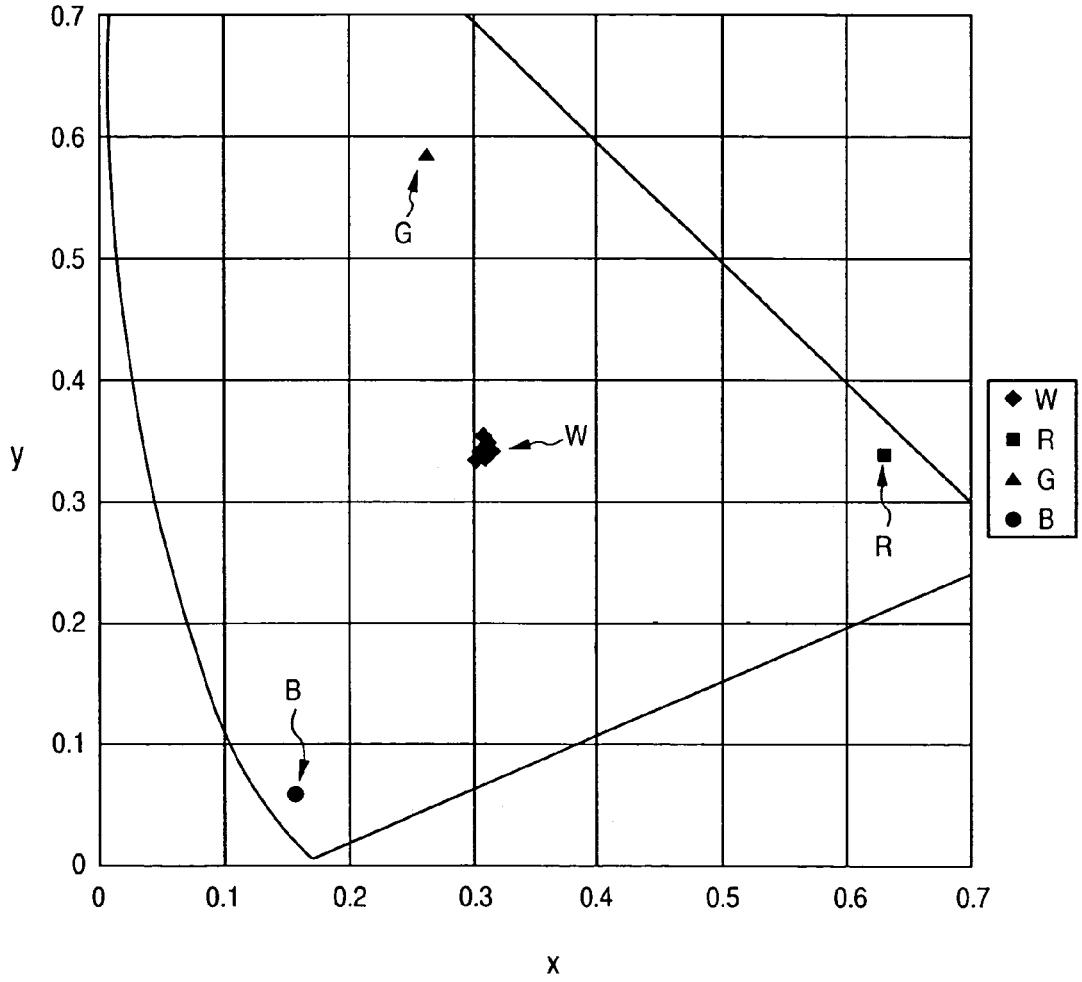
FIG. 7 is a graph showing a change in white chromaticity point by tone data when the frame rate is converted.

FIG. 7 shows a change in white chromaticity point by tone data when the frame rate is converted. As is apparent from FIG. 7, the chromaticity point hardly changes, compared to FIG. 5. In FIG. 7, the change amount of the white chromaticity point falls within ±0.01 or less on the (x,y) coordinates, which is negligible level.

The allowable range for the change amount of the white chromaticity point changes depending on the application purpose of a display apparatus for use. For, e.g., a home TV receiver, the change amount suffices to be 0.03 or less on the (x,y) coordinates. For a monitor requiring high-precision color reproduction, the change amount must be strictly suppressed.

Figure 8:
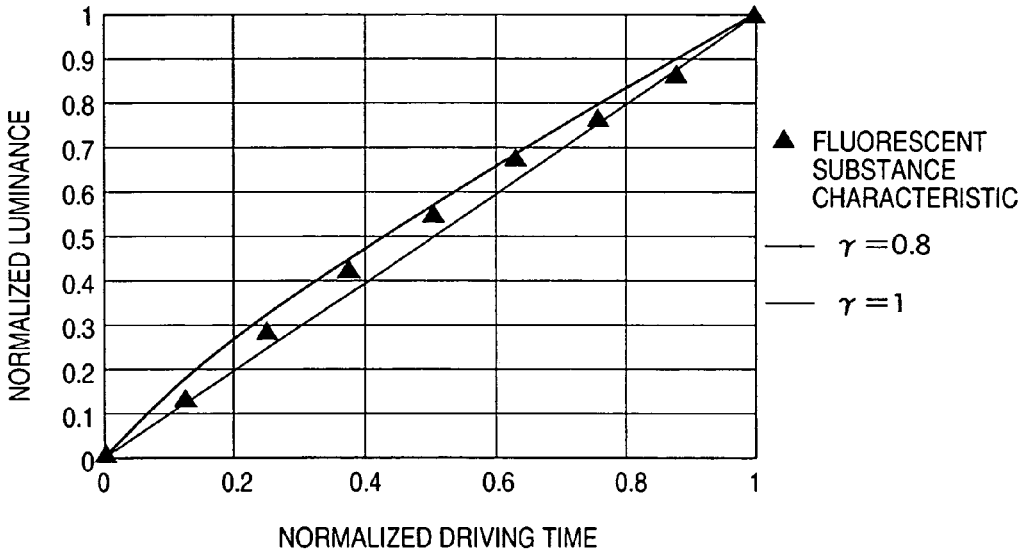
FIG. 8 is a graph extracted from FIG. 6, showing a tone characteristic when the frame rate is converted.
Figure 9:
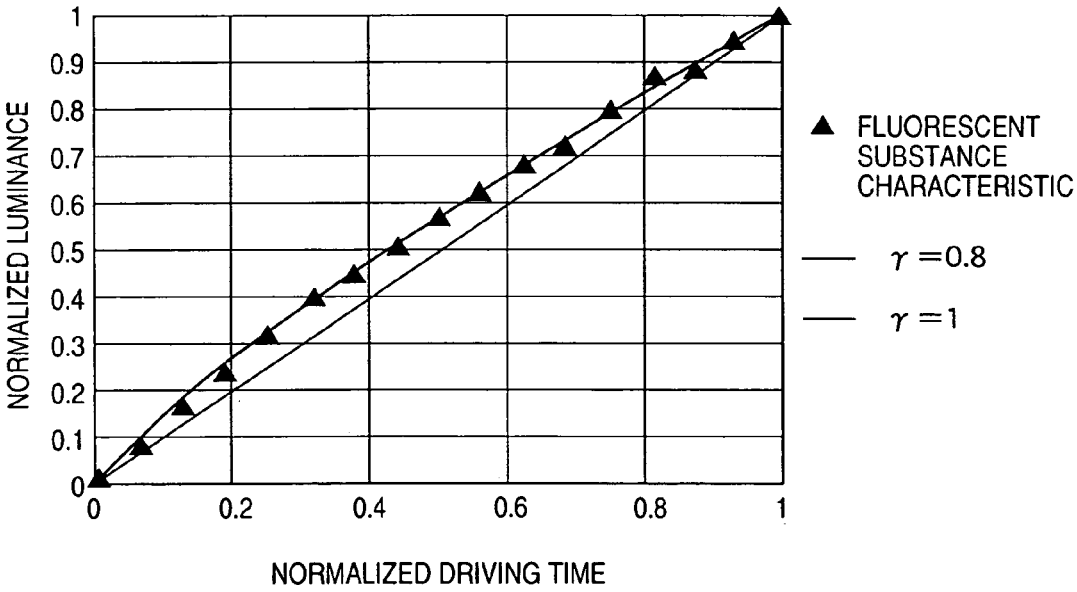
FIG. 9 is a graph extracted from FIG. 6, showing a tone characteristic when no frame rate is converted.
Figure 10:
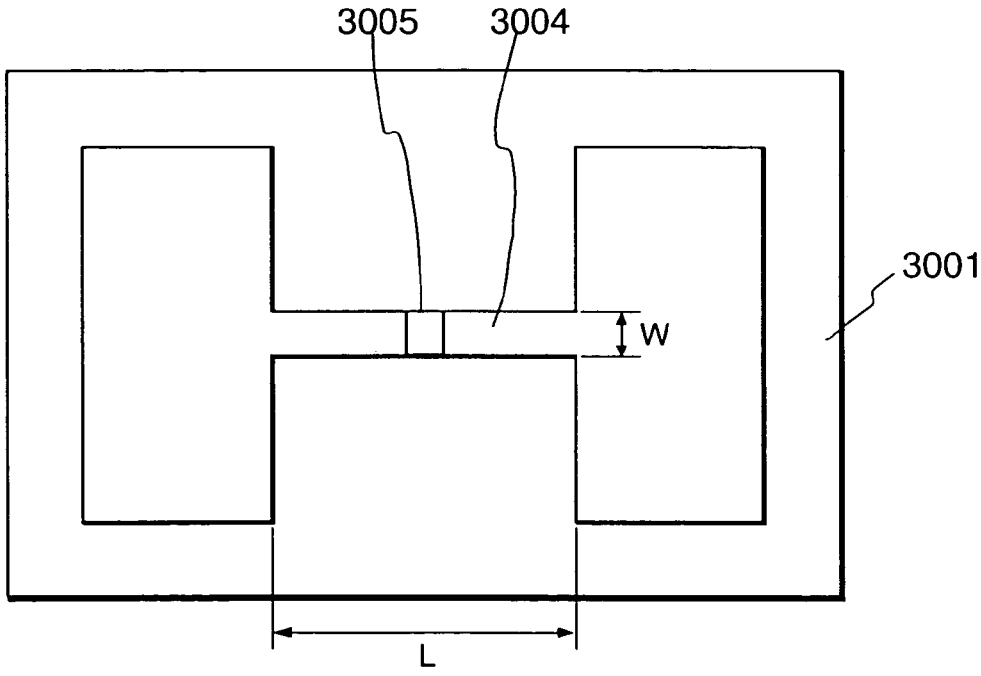
FIG. 10 is a plan view showing a conventionally known surface-conduction type electron-emitting device.
Figure 11:
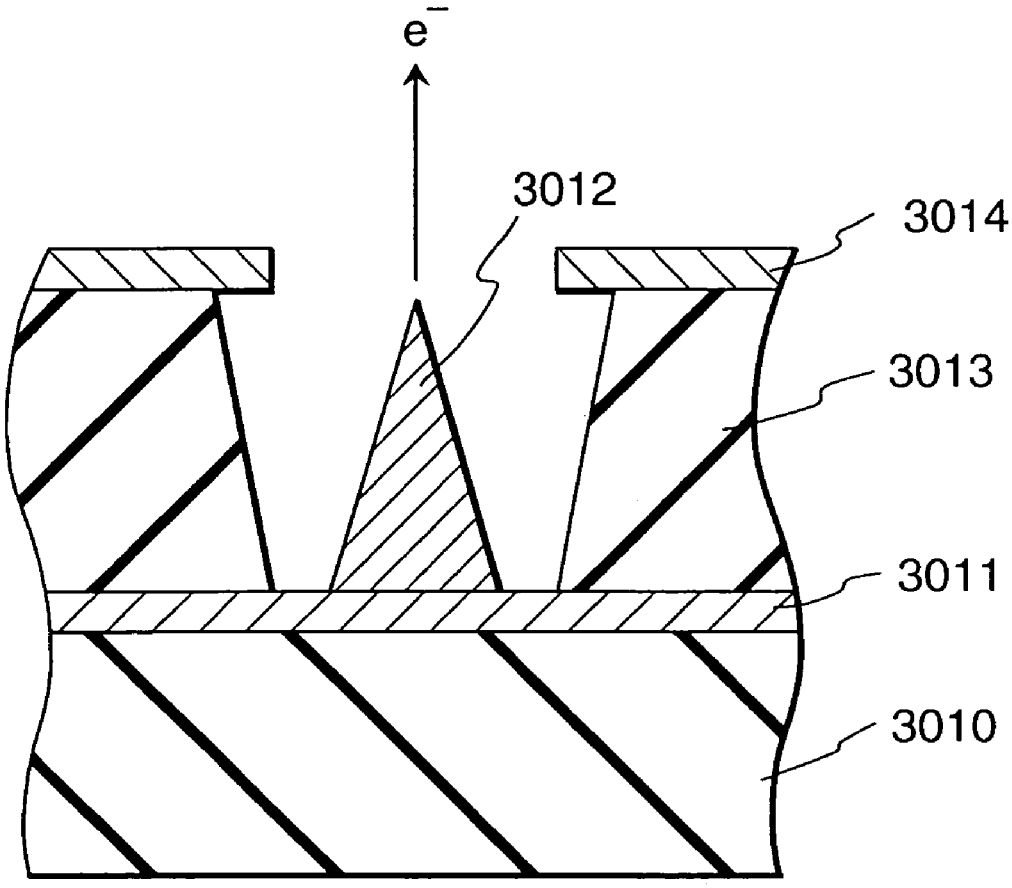
FIG. 11 is a sectional view showing a conventionally known FE type device.
Figure 12:
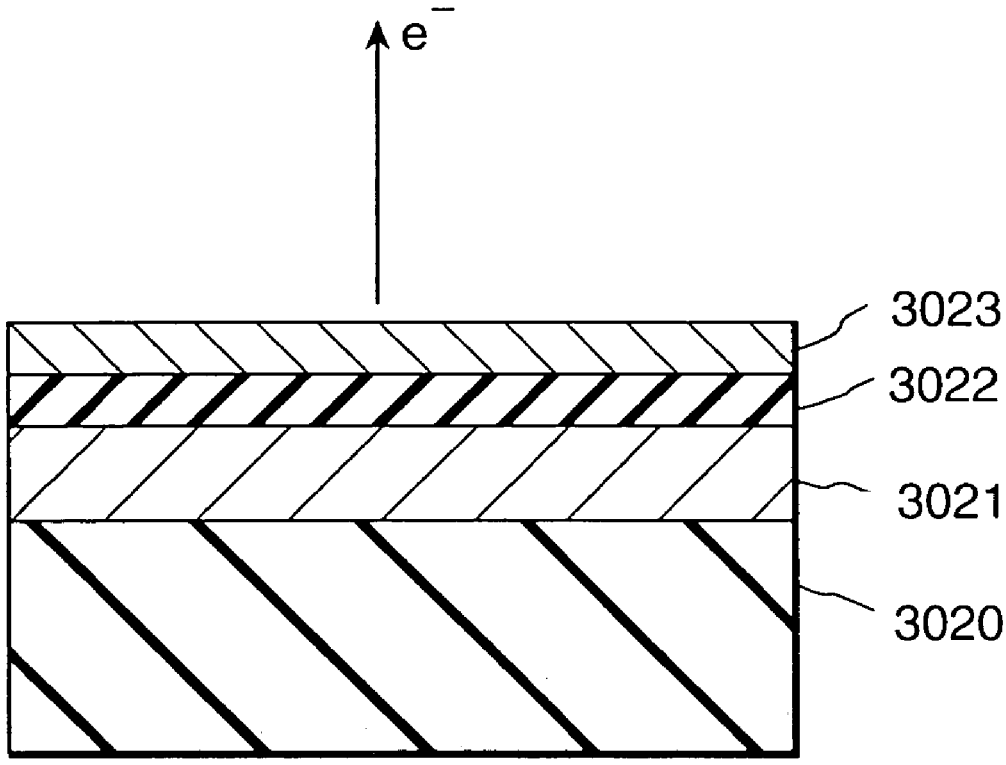
FIG. 12 is a sectional view showing a conventionally known MIM type device.

FIG. 8 shows a tone characteristic when the frame rate is converted that is extracted from FIG. 6, and FIG. 9 shows a tone characteristic extracted from FIG. 6 when no frame rate is converted. The abscissa represents the normalized driving time using as 1 the maximum pulse width (maximum electron irradiation time for fluorescent substances), which corresponds to normalized tone data. The ordinate represents the normalized luminance using as 1 the emission amount for the maximum pulse width (maximum electron irradiation time for fluorescent substances).

As shown in FIGS. 8 and 9, frame rate conversion halves the maximum pulse width to greatly improve the saturation characteristic of the fluorescent substance.

FIGS. 8 and 9 show both a curve of $y=x^{\gamma}$ for γ=0.8 and a straight line of γ=1.0. When the frame rate is converted, the γ value of the fluorescent substance characteristic substantially falls within the range of 0.8 to 1.0. However, when no frame rate is converted, the γ value exceeds this range. That is, in FIGS. 8 and 9, the change amount falls within Δxy=0.03 as far as the γ value falls within the range of 0.8 to 1.0. In a limited application purpose such as a home TV receiver, the luminance characteristic corresponding to the electron irradiation time for fluorescent substances can be regarded as a straight line as far as the γ value falls within the range of 0.8 to 1.0.

The maximum irradiation time range within which the luminance characteristic can be regarded as a straight line (linearity is not substantially degraded) is as follows. Normalized luminance points at measurement points having sufficiently short uniform time intervals (less than 5 μs) are plotted on a graph whose abscissa x and ordinate y represent the normalized driving time and normalized luminance, respectively. In this case, the maximum irradiation time range is preferably defined such that points not falling within a range (including the boundary) defined by lines y=x and $y=x^{0.8}$ out of points except for normalized luminance points for x=0 and x=1 are 4/15 or less.

FIG. 4 shows an example of the emission characteristic. This characteristic changes depending on the amount of emitted electrons which irradiate fluorescent substances, a high acceleration voltage, and the type of fluorescent substance.

For this reason, even a double frame rate may be insufficient. This embodiment employs the I/P converter as a frame rate converter. For example, the embodiment shown in FIGS. 1A to 1C converts a frame rate of 30 Hz into 60 Hz. The frame rate of 30 Hz can be converted into 90 Hz or 120 Hz by the arrangement shown in FIGS. 1A to 1C. That is, the present invention can use any frame rate value so long as the frame rate converter can convert image data input at a given frame rate into image data having a frame rate which sets the electron irradiation time for fluorescent substances to a time during which a linear fluorescent substance luminance characteristic can be maintained (time during which the fluorescent substance luminance characteristic can be regarded as a straight line).

In the embodiment of FIGS. 1A to 1C, the tone is expressed by pulse width modulation. However, the present invention is not limited to this, and may express the tone by changing the driving amount (current amount flowing through the device or application voltage amplitude) with a constant pulse width applied to the device. The application pulse width can be shortened not only by pulse width modulation but also by increasing the frame rate, so that the saturation characteristic of the fluorescent substance can be similarly moderated.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus including a plurality of electron-emitting devices wired in a matrix, and fluorescent substances for emitting light by electrons emitted by the electron-emitting devices, further comprising:

a circuit configured to output an image signal, based on an input image signal, wherein a frame rate of an image formed by the image signal is higher than a frame rate of the input image signal, wherein the image signal output by said circuit satisfies the following conditions:

x is a normalized driving time period normalized to a maximum time period, during which time the fluorescent substances are continuously irradiated with electrons emitted from the electron-emitting devices driven by the image signal output from said circuit, y is a normalized luminance normalized to an amount of light emitted by the fluorescent substances, resulting from irradiation by electrons emitted from the electron-emitting devices in the maximum time period, in a graph whose abscissa x and ordinate y, a plurality of normalized luminance points which are measured at a plurality of driving time periods, each of which has equal time intervals less than 5 μs are plotted on the graph, wherein the plurality of driving time periods do not include x=0 and x=1, the number of normalized luminance points not falling within a range defined by lines y=x and $y=x^{0.8}$ on the graph, wherein the range includes a border, is 4/15 or less of the number of the plurality of normalized luminance points;

a plurality of memories including a first memory and a second memory, each of which is configured to store a part of the image signals of one line of the image;

a controller configured to control reading of the image signals from said plurality of memories; and a plurality of shift registers including a first shift register and a second shift register, the first shift register is configured to input an image signal output from the first memory, and said second shift register is configured to input an image signal output from the second memory.

2. The image forming apparatus according to claim 1, wherein said circuit converts a signal for an interlaced scanning into a signal for a non-interlaced scanning.

3. The image forming apparatus according to claim 1, further comprising means for performing pulse width modulation by the image signal output from said circuit.

4. The image forming apparatus according to claim 1, wherein the electron-emitting devices are surface-conduction type electron-emitting devices.

5. The image forming apparatus according to claim 1, further comprising an electrode to which a potential for accelerating electrons emitted by the electron-emitting devices applies, wherein the potential is higher by not less than 500 V than a potential applied to the electron-emitting devices in order to emit electrons.

6. The image forming apparatus according to claim 1, further comprising an electrode to which a potential for accelerating electrons emitted by the electron-emitting devices applies, wherein the potential is higher by not less than 3 kV than a potential applied to the electron-emitting devices in order to emit electrons.

7. The image forming apparatus according to claim 1, further comprising an electrode to which a potential for accelerating electrons emitted by the electron-emitting devices applies, wherein the potential is higher by not less than 5 kV than a potential applied to the electron-emitting devices in order to emit electrons.

8. The image forming apparatus according to claim 1, wherein the plurality of electron emitting devices and the fluorescent substances are arranged apart from each other.

9. The image forming apparatus according to claim 1, wherein said first memory comprises:

a memory which is configured to store a part of a first color image signal of one line of the image, a memory which is configured to store a part of a second color image signal of one line of the image, a memory which is configured to store a part of a third color image signal of one line of the image, and the second memory comprises a memory which is configured to store another part of the first color image signal of one line of the image, a memory which is configured to store another part of the second color image signal of one line of the image, and a memory which is configured to store another part of the third color image signal of one line of the image.

* * * * *

UNITED STATES PATENT AND TRADEMARK OFFICE

CERTIFICATE OF CORRECTION

PATENT NO. : 7,307,606 B1
APPLICATION NO. : 09/542460
DATED : December 11, 2007
INVENTOR(S) : Yamazaki et al.

It is certified that error appears in the above-identified patent and that said Letters Patent is hereby corrected as shown below:

TITLE PAGE, AT ITEM [56], References Cited:

FOREIGN PATENT DOCUMENTS:

"05150743" should read --05-150743--.

COLUMN 8:

Line 21, "ever" should read --every--.

COLUMN 15:

Line 7, "the first" should read --said first--.

COLUMN 16:

Line 10, "electron emitting devices" should read --electron-emitting devices--.

Signed and Sealed this

Seventh Day of April, 2009

John Doll

JOHN DOLL
*Acting Director of the United States Patent and Trademark Office*